US008025531B1

(12) United States Patent
Zhang et al.

(10) Patent No.: US 8,025,531 B1
(45) Date of Patent: Sep. 27, 2011

(54) SHIELDED SOCKET HOUSING

(75) Inventors: Zhichao Zhang, Chandler, AZ (US); Joshua D. Heppner, Chandler, AZ (US); Kemal Aygun, Chandler, AZ (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 12/970,663

(22) Filed: Dec. 16, 2010

(51) Int. Cl.
*H01R 13/648* (2006.01)

(52) U.S. Cl. ..... 439/607.05

(58) Field of Classification Search ..... 439/607.05, 439/607.1, 607.08, 607.12, 92, 108
See application file for complete search history.

(56) References Cited

U.S. PATENT DOCUMENTS 6,471,525 B1 10/2002 Fan et al.
6,494,743 B1 * 12/2002 Lamatsch et al. ..... 439/607.05
6,780,057 B2 8/2004 Figueroa et al.
6,877,223 B2 * 4/2005 Figueroa et al. ..... 29/884
7,448,883 B2 * 11/2008 Alden et al. ..... 439/91
7,604,502 B2 * 10/2009 Pan ..... 439/607.08
7,622,793 B2 11/2009 Anderson
7,726,976 B2 6/2010 Mason et al.
2002/0036446 A1 * 3/2002 Toda et al. ..... 310/328
2002/0192994 A1 12/2002 Turner et al.
2008/0188127 A1 * 8/2008 Alden et al. ..... 439/608

OTHER PUBLICATIONS

"Laser Direct Structuring" Tyco Electronics, 2010, 1 page, accessed at http://www.tycoelectronics.com/mid/lasertech.asp.
"2 Shot" Tyco Electronics, 2010, 1 page, accessed at http://www.tycoelectronics.com/mid/2shot.asp.

* cited by examiner

*Primary Examiner* — Chandrika Prasad
(74) *Attorney, Agent, or Firm* — Blakely, Sokoloff, Taylor & Zafman LLP

(57) ABSTRACT

A shielded socket and method of fabrication is described. In an embodiment, a socket is formed of a conductive polymer socket housing, and at least one conductive contact is in electrical contact with the conductive polymer socket housing. In an embodiment, a socket is formed of an insulative socket housing, and at least one conductive contact is in electrical contact with a conductive grid embedded within the insulative housing.

20 Claims, 9 Drawing Sheets

SHIELDED SOCKET HOUSING

BACKGROUND OF THE INVENTION

1. Field of the Invention

The present invention relates to a shielded socket for an electrical device, and more particularly, to a shielded land grid array (LGA) socket.

2. Discussion of Related Art

The ongoing trend toward increased performance and higher density electrical circuits has led to the development of surface mount technology in the design of electronic packages and printed circuit boards (PCBs). As the amount of memory increases in electronic systems so does the amount of bandwidth required for the processors, and resultantly the number of in/out (I/O) connections.

Sockets are commonly used to enable multiple insertions of packages onto PCBs (e.g. mother boards) or other substrates. Due to the close proximity of the I/O connections to each other crosstalk has become an important performance issue. Crosstalk results from the coupling of the electromagnetic field surrounding an active conductor into an adjacent conductor. In addition, matched impedance for socket contacts is desired to minimize signal reflections which can result in false triggering or missed triggering of devices.

Conventional socket improvement is based on redesigning the socket geometrical shape. This involves long socket design and validation processes, does not provide optimal electrical performance, and is not friendly to socket persistence over generations. Contact to contact isolation is generally achieved by assigning a number of contacts as ground. Isolation is not ideal due to the contact geometry limitation and insufficient signal contact to ground contact ratio.

DETAILED DESCRIPTION OF THE PRESENT INVENTION

Figure 1:
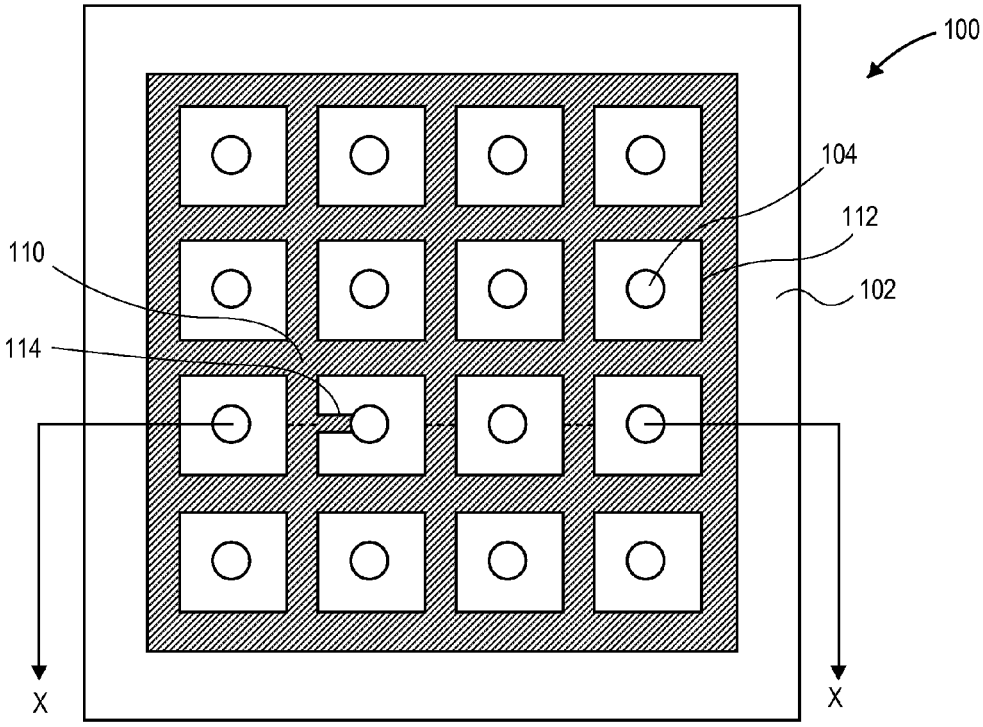
FIG. 1 is an illustration of a top view of a partially formed socket in accordance with embodiments of the invention.

In various embodiments, shielded land grid array (LGA) socket structures and methods of formation are described with reference to figures. However, certain embodiments may be practiced without one or more of these specific details, or in combination with other known methods and materials. In the following description, numerous specific details are set forth, such as specific materials, dimensions and processes, etc., in order to provide a thorough understanding of the present invention. In other instances, well-known semiconductor processes and manufacturing techniques have not been described in particular detail in order to not unnecessarily obscure the present invention. Reference throughout this specification to "an embodiment" means that a particular feature, structure, material, or characteristic described in connection with the embodiment is included in at least one embodiment of the invention. Thus, the appearances of the phrase "in an embodiment" in various places throughout this specification are not necessarily referring to the same embodiment of the invention. Furthermore, the particular features, structures, materials, or characteristics may be combined in any suitable manner in one or more embodiments.

Land grid array (LGA) packages generally include a housing with an array of exposed lands on a bottom surface of the package. Unlike pin grid array (PGA) packages there are no contact pins that extend away from the bottom surface of the LGA package. Embodiments of the present invention relate to shielded LGA socket structures which may accommodate LGA packages and electrically connect LGA packages to PCBs or other substrates. In an embodiment, a system includes an LGA package housing an IC such as a microprocessor, and a socket connecting the LGA package to a PCB. The LGA socket may include an array of compliant contacts disposed within a housing, the compliant portions of the compliant contacts aligned with the corresponding array of exposed lands on a bottom surface of the LGA package.

In an embodiment, a socket includes a conductive polymer housing and an array of contact openings within and surrounded by the conductive polymer housing and extending from a top surface to a bottom surface of the conductive polymer housing. A corresponding array of conductive contacts are disposed within the array of contact openings. A plurality of the conductive contacts may be electrically isolated from the conductive polymer housing which surrounds the array of conductive contacts. At least one of the conductive contacts is in electrical contact with the conductive polymer housing. In an embodiment, the socket connects an LGA package to a circuit board, and the conductive contact which is in electrical contact with the conductive polymer housing is electrically connected to a ground in the circuit board thereby grounding the conductive polymer housing. Accordingly, the conductive polymer housing functions as a ground plane that surrounds the signal carrying and power conducting contacts. The conductive polymer housing may be formed of a variety of materials such liquid crystal polymer (LCP).

The plurality of conductive contacts may be electrically isolated from the conductive polymer housing in a variety of manners. In an embodiment, the plurality of conductive contacts are coated with an insulative coating prior to inserting the plurality of conductive contacts into the corresponding array of contact openings. For example, the insulative coatings can be laminated or cast onto the plurality of conductive contacts, and then the plurality of conductive contacts can be press-fit into the array of contact openings. In an embodiment, an insulative layer is formed within the array of contact openings prior to press-fitting the plurality of conductive contacts into the array of contact openings to electrically isolate the plurality of conductive contacts from the conductive polymer housing. In order to electrically connect the conductive polymer housing to at least one contact which is connected to ground either at least one contact is not coated with an insulative material, or an insulative layer is not formed within the corresponding contact opening.

In an embodiment a socket includes an insulative housing and an array of contact openings within and surrounded by the insulative housing and extending from a top surface to a bottom surface of the insulative housing. A corresponding array of conductive compliant contacts are disposed within the array of contact openings, and a conductive grid is embedded within the insulative housing. The conductive grid may include an array of grid openings corresponding to the array of contact openings, with each individual grid opening surrounding a respective contact opening. A plurality of the conductive compliant contacts are electrically isolated from the conductive grid by the insulative housing. At least one of the conductive compliant contacts is in electrical contact with the conductive grid. Accordingly, the conductive grid functions as a ground plane that surrounds the signal carrying and power conducting contacts. The insulative housing may be formed of a variety of insulative materials such as liquid crystal polymer (LCP) or a wave absorbing glass fiber reinforced liquid crystal polymer (LCP). Other insulative housing materials include FR-4 epoxy, polyamides, BT, polybutylene terepthalate (PBT), polyethylene terepthalate (PET), polycyclohexylenedimethylene terepthalate (PCT), polyphenylene sulfide (PPS), cyanate ester, though other materials may be used. The conductive grid may be formed of a variety of conductive materials. In an embodiment the conductive grid is formed of a metal, such as copper or aluminum.

The manner of forming the conductive grid and manner of connecting the conductive grid to at least one of the conductive compliant contacts may be accomplished in a variety of ways. In an embodiment, the conductive grid may be formed by laser direct structuring of a molded resin, in which a 3D laser system is used to form a pattern in the molded resin corresponding to the conductive grid and activate the resin in the pattern. The activated resin may then be plated to form the conductive grid. In accordance with some embodiments, the insulative housing may be include two housing pieces which are patterned prior to joining the two pieces together. In an embodiment, the array of contact openings extends from a top surface of the first piece (e.g. top piece) to a bottom surface of the second piece (e.g. bottom piece). The second piece may include a pattern of indentations which correspond to the conductive grid. In an embodiment, a pre-formed conductive grid is placed into the pattern of indentations. In an embodiment, a seed layer (or activated resin) is formed within the indendations and the conductive grid is plated within the indentations. In an embodiment, the socket is formed by a two-shot molding process in which a first piece is formed in part of a non-platable resin and in part of a platable resin. Plating is performed on the platable resin portion to form the conductive grid. A second piece may then be joined to the first piece to form the socket housing with an embedded conductive grid. In an embodiment, a flexible circuit film is disposed between the first and second pieces. The flexible circuit film including the conductive grid may be placed over a second molded piece having protrusions, and the first piece having indentations is forced down over the flexible circuit film. The flexible circuit complies with the protrusions/indentations of the two pieces and is contained with the housing In accordance with embodiments of the present invention, LGA sockets are described which may improve socket high speed in out (HSIO) electrical performance for both intersymbol interference (ISI) and crosstalk limited channels. The shielded and grounded housing may provide improved isolation between adjacent contacts at any angle, and good ground reference and return path for socket signal contact with reduced inductance and resultant impedance mismatch. The shielded and grounding housing may eliminate the need for assigning a significant number of socket contacts as ground. This may reduce the number of contacts needed and allow package form factor and associated PAT cost reduction, or improve the per socket bandwidth by leveraging contacts by assigning freed contacts to other I/Os with the same socket. Embodiments of the invention may be compatible with existing socket geometric shape, require little change to socket design and manufacturing processes, reduce product cycles, and assist socket persistence over generations.

Figure 2A:
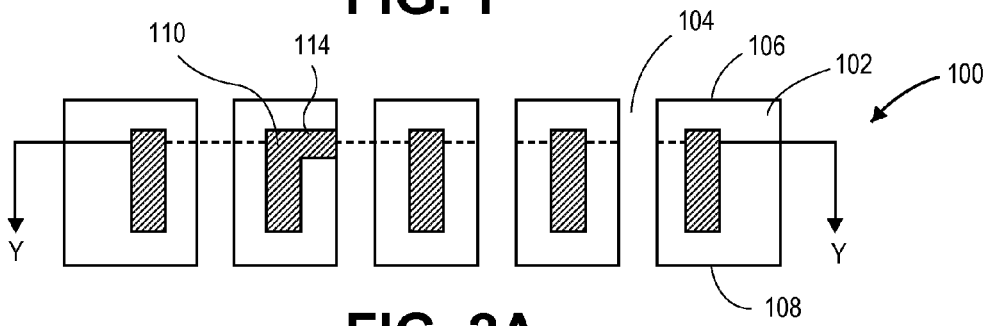
FIGS. 2A-2B are illustrations of a cross-sectional view of socket in accordance with embodiments of the invention.

FIG. 1 and FIG. 2A are illustrations of a partially formed socket in accordance with embodiments of the invention. FIG. 1 is an illustration of a top view taken along line y-y in FIG. 2A. FIG. 2A is an illustration of a side view taken along line x-x in FIG. 1. Socket 100 includes an insulative housing 102 and an array of contact openings 104 within and surrounded by the insulative housing 102. The array of contact openings 104 extend from a top surface 106 to a bottom surface 108 of the insulative housing 102. A conductive grid 110 is embedded within the insulative housing 102. Referring to FIG. 1, the conductive grid includes an array of grid openings 112 corresponding to the array of contact openings 104. Each individual grid opening 112 surrounds a respective contact opening 104. In an embodiment, the conductive grid 110 is formed by a series of conductive walls running parallel to the contact openings 104. In an embodiment, the height of the conductive walls is less than the total height of the housing 102 so that the conductive grid 110 is not exposed on the top and bottom surfaces 106, 108 thereby protecting against possible shorting. In addition, it is also possible for the number of grid openings 112 to correspond to and surround a plurality of contact openings 104. It is to be appreciated that while the conductive grid is described and illustrated as being formed of vertical walls and including square grid openings that embodiments of the invention are not limited to such. It is contemplated that other arrangements such as circular, elliptical or polygonal structures may be utilized depending up other geometric and device considerations.

Figure 2B:
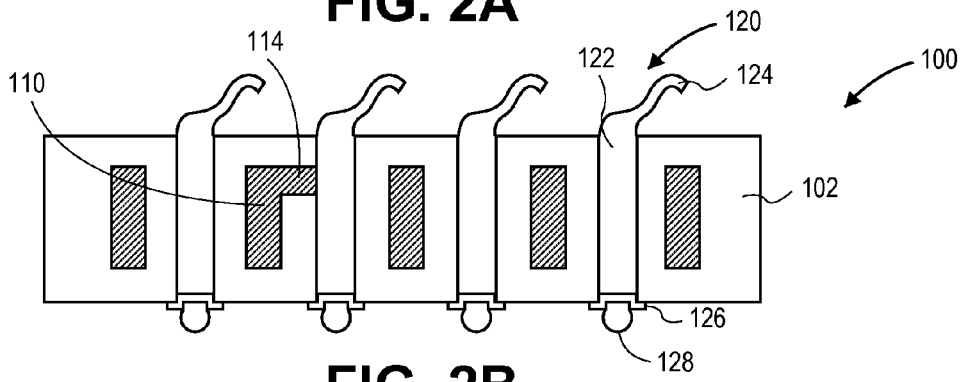
Figure 3A:
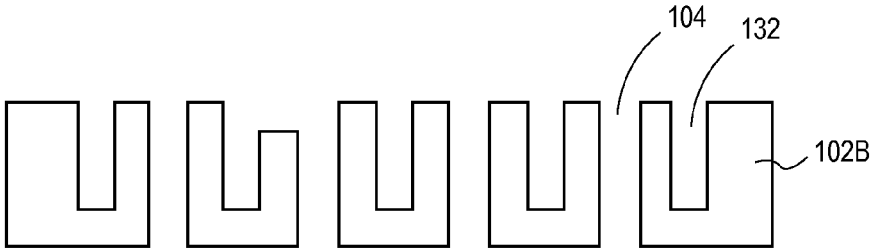
FIGS. 3A-3D are illustrations of a cross-sectional view of socket formed with first and second housing pieces in accordance with embodiments of the invention.
Figure 3B:
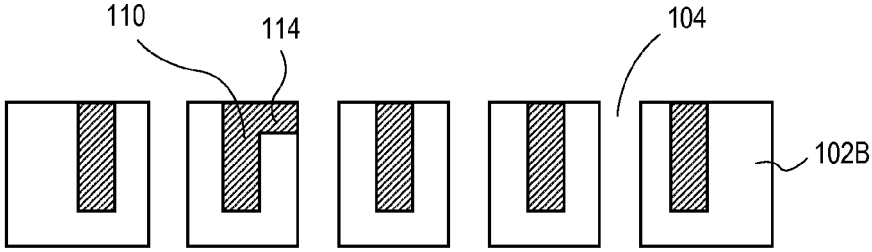
Figure 3C:
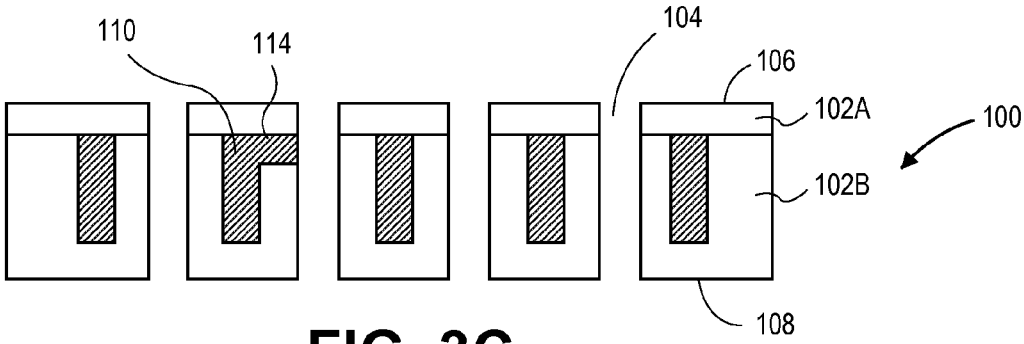
Figure 3D:
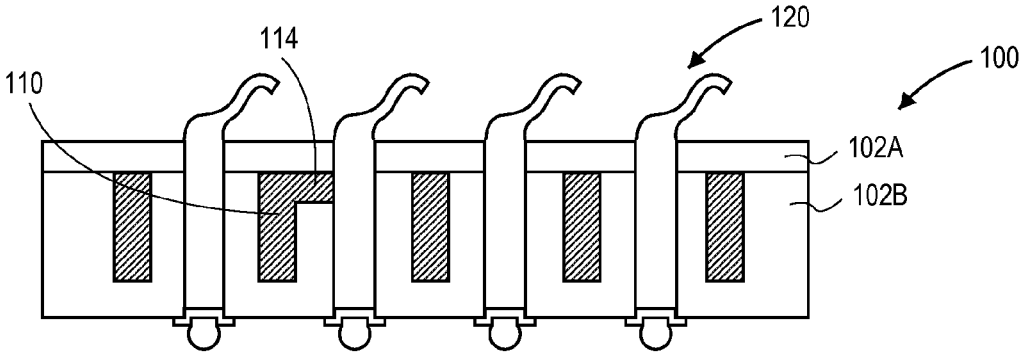

Referring to FIG. 2B, an array of conductive compliant contacts 120 are disposed within the corresponding array of contact openings 104. As illustrated, the conductive compliant contacts 120 may include a via portion 122 extending through the body of the insulative housing 102 and a compliant portion 124 above the top surface 106 of the insulative housing 102. For example, the compliant portion 124 may resemble a spring contact which exerts a force against an exposed land of an LGA package when fastened onto the socket 100. In an embodiment, the conductive compliant contacts 120 may include a bonding pad 126 and solder ball 128 for connecting to a substrate such as a printed circuit board (PCB). In another embodiment, the bonding pad and solder ball may be replaced with a pin (not illustrated) for connecting to a substrate. In addition, embodiments are described and illustrated in which the number of grid openings 112 corresponds directly to the number of contact openings 104, however other ratios are contemplated and embodiments of the present invention are not to be limited as such. For example, it is also contemplated that multiple contact openings may be disposed within a single grid opening depending upon other geometric and device considerations.

In accordance with embodiments the array of conductive compliant contacts 120 may be inserted into the corresponding array of contact openings 104 by press-fitting. For example, a pick and place machine can be utilized, or the conductive compliant contacts 120 can be manually press-fit. In an embodiment, an array of conductive compliant contacts 120 connected by a cross bar are press-fit into the corresponding array of contact openings, and the cross bar is subsequently removed. As previously described, bonding pads 126, solder balls 128 or pins may be connected to the conductive compliant contacts 120. Depending on particular processing circumstances, any of the bonding pads 126, solder ball s128 or pins may be formed prior to or subsequent to press-fitting the conductive compliant contacts 120 into the contact openings 104. In other embodiments, contacts 120 can be formed through known deposition and growth techniques as known in the art as opposed to press-fitting.

Still referring to FIG. 1-FIG. 2B, a portion of the insulative housing 102 is disposed between individual grid openings 112 and corresponding contact opening 104 in order to electrically isolate the corresponding conductive compliant contacts 120 from the conductive grid 110. In an embodiment, at least one of the conductive compliant contacts 120 is in electrical contact with the conductive grid 110. As illustrated, the conductive grid 110 may include a conductive trace 114 spanning between a wall of the conductive grid and one of the contact openings 104 to make contact with the via portion 122 of a conductive compliant contact 120 disposed within the contact opening 104.

In an embodiment, insulative housing 102 includes a liquid crystal polymer (LCP) or a wave absorbing glass fiber reinforced liquid crystal polymer (LCP). Other insulative housing materials include FR-4 epoxy, polyamides, BT, polybutylene terepthalate (PBT), polyethylene terepthalate (PET), polycyclohexylenedimethylene terepthalate (PCT), polyphenylene sulfide (PPS), cyanate ester, though other materials may be used. In an embodiment, conductive grid 110 is formed of a metal such as copper.

Socket 100 may be formed in a variety of ways. Referring to FIG. 3A-FIG. 3D the socket may be formed with first and second housing pieces in accordance with certain embodiments. As illustrated, socket 100 may be include a first piece 102A and a second piece 102B, and the array of contact openings 104 align in the first and second pieces so that the contact openings 104 extend from a top surface 106 of the first piece 102A to a bottom surface 108 of the second piece 102B. The second piece 102B may include indentations 132 which correspond to the conductive grid 110, including the conductive trace 114. A preformed conductive grid 110, including conductive trace 114 may then be placed within the indentations of the second piece 102B and the first piece 102A and second piece 102B joined together. In an embodiment, an adhesive may be used to affix the conductive grid to the second piece, as well as to join the first piece 102A to the second piece 102B. Conductive compliant contacts 120 may then be press-fit into the array of openings 104 as previously described.

The first and second pieces 102A and 102B may be formed in several different ways. In one embodiment, first and second pieces 102A and 102B are molded, for example by injection molding. For example, any protrusions or indentations in the first and second pieces 102A and 102B can be formed during the molding process. It is also possible to form any protrusions or indentations by other methods such as etching or laser writing.

Referring to FIG. 4A-FIG. 4E plating may be utilized to form the conductive grid in accordance with certain embodiments. Similarly as with FIG. 3A-FIG. 3D, a first and second housing pieces 102A and 102B may be utilized. Indentations 132 may be formed in the second piece 102B. For example, indentations 132 and contact openings 104 may be formed during a molding operation. In an embodiment, indentations 132 are formed by laser writing.

Figure 4A:
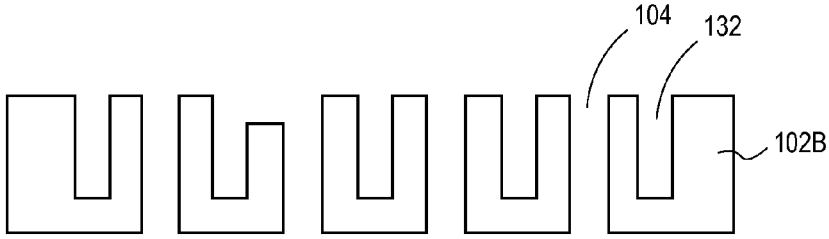
FIGS. 4A-4E are illustrations of a cross-sectional view of socket formed with plating a conductive grid in accordance with embodiments of the invention.
Figure 4B:
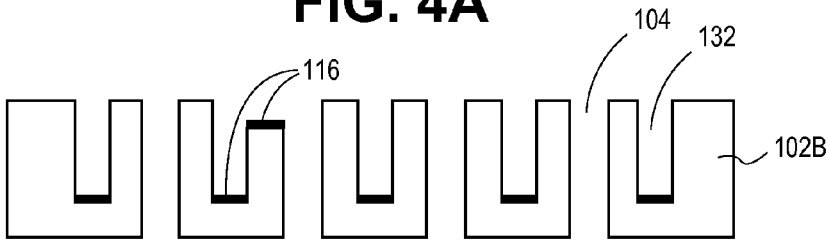

Referring to FIG. 4B, a conductive seed layer 116 may be formed within the indentations 132. In an embodiment, a conductive seed layer 116 may be deposited, by a physical vapor deposition (PVD) technique such as sputtering, or a chemical vapor deposition technique. Depending upon deposition technique the conductive seed layer 116 may be applied anisotripically only on the top surfaces of the indentations 132 or also on the sidewalls of indentations 132. Seed layer 116 may be formed of the same material or different material than conductive grid 110. In another embodiment, a conductive seed layer 116 may be formed by activating a surface of the second piece 102B. For example, a 3D laser system can be used to activate the top surfaces, and optionally sidewalls, of indentations 132. In an embodiment, second piece 102B may be formed of a specialized resin material which is insulative, but may be activated and made conductive with laser energy.

Figure 4C:
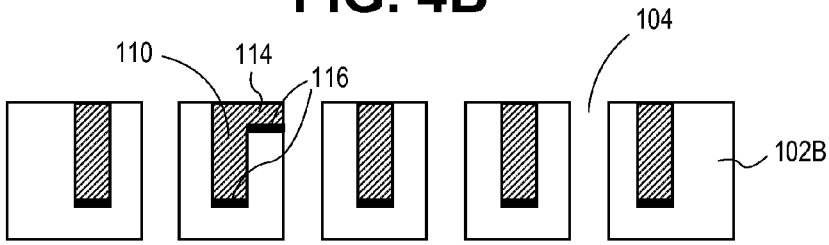
Figure 4D:
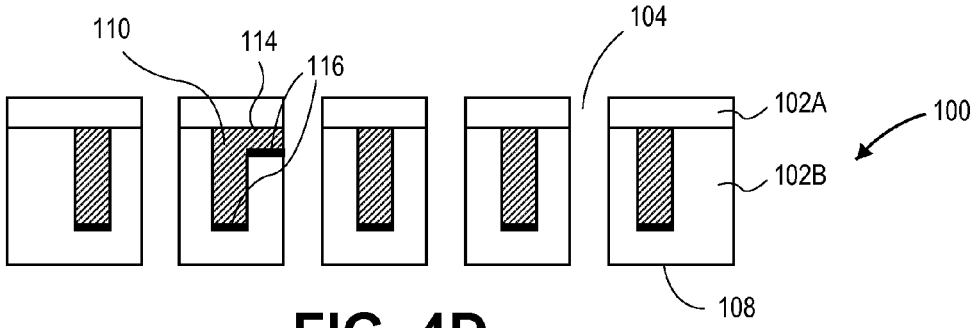
Figure 4E:
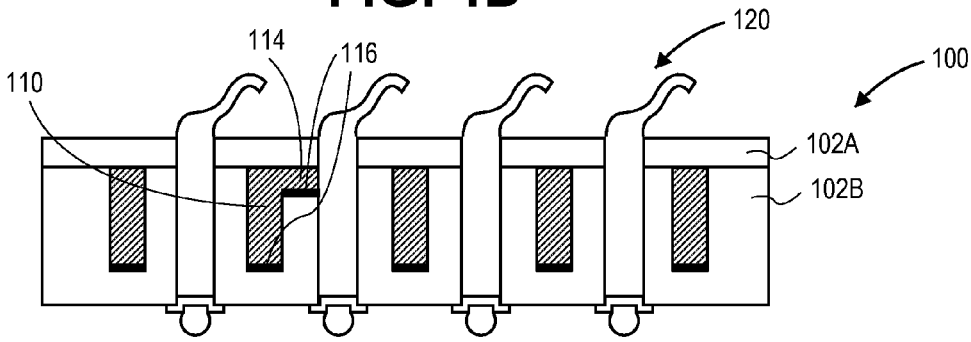

Referring to FIG. 4C, plating may then be performed to build the conductive grid 110, including conductive trace 114 on top of the seed layer 116 and within the indentations 132. The first piece 102A may then be joined to the second piece 102B, and conductive compliant contacts 120 may then be press-fit into the array of openings 104 as previously described.

Figure 5A:
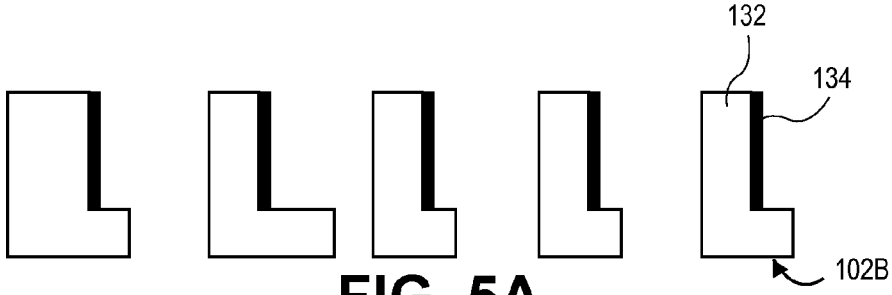
FIGS. 5A-5D are illustrations of a cross-sectional view of socket formed with 2-shot molding in accordance with embodiments of the invention.
Figure 5B:
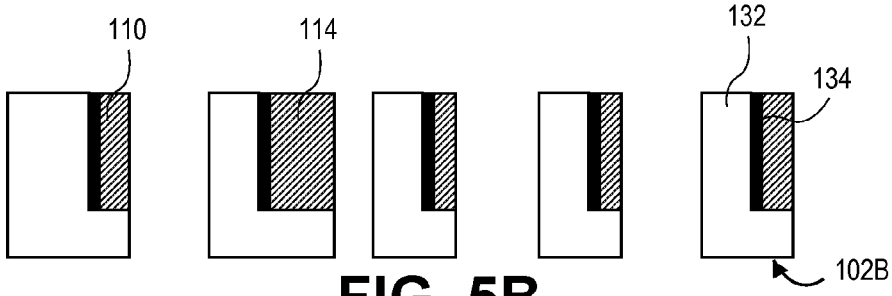
Figure 5C:
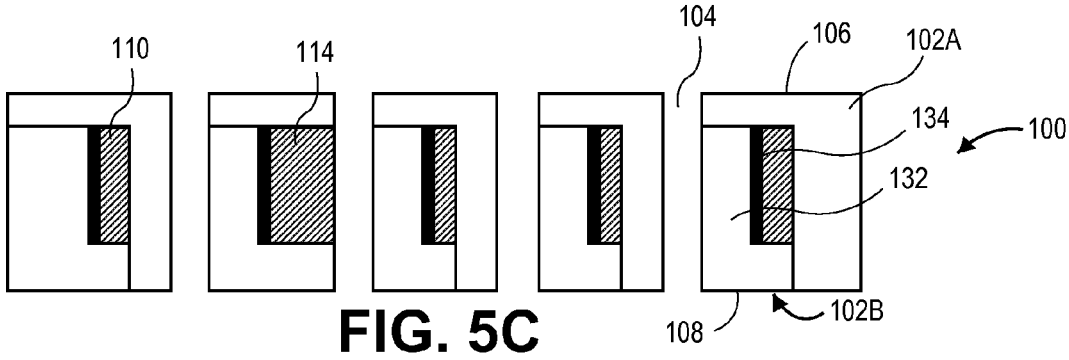
Figure 5D:
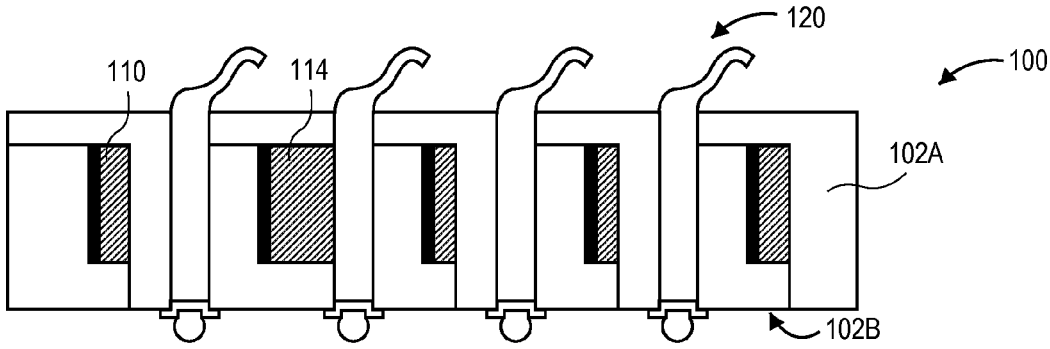

Referring to FIG. 5A-FIG. 5D, 2-shot molding may be utilized to form the socket in accordance with certain embodiments. Referring to FIG. 5C, the socket may be formed with first and second housing pieces in accordance with certain embodiments. As illustrated, socket 100 may be include a first piece 102A and a second piece 102B, and the array of contact openings 104 align in the first and second pieces so that the contact openings 104 extend from a top surface 106 of the first piece 102A to a bottom surface 108 of the second piece 102B.

In an embodiment, 2-shot molding combines injection molding of two distinct polymers with plating to produce a selectively plated component. In order to achieve the selectivity during plating a catalyzed platable resin is molded in conjunction with a standard non-plateable resin to define the desired area to be plated. The plated area may have the benefit of accurate tolerance and registration due to the fact that it is created by molding, and which also has the capability of producing complex 3D geometries that are difficult to produce using alternative technologies. Referring to FIG. 5A, the second piece 102B may include a platable resin portion 134 and a non-platable resin portion 132. Plating is then performed to form the conductive grid 110, including conductive trace 114, on the 2 second piece 102B. Referring to FIG. 5C, the first piece 102A and second piece 102B may then be joined together. For example, the first and second pieces 102A and 102B may be joined with an adhesive. Conductive compliant contacts 120 may then be press-fit into the array of openings 104 as previously described.

Figure 6A:
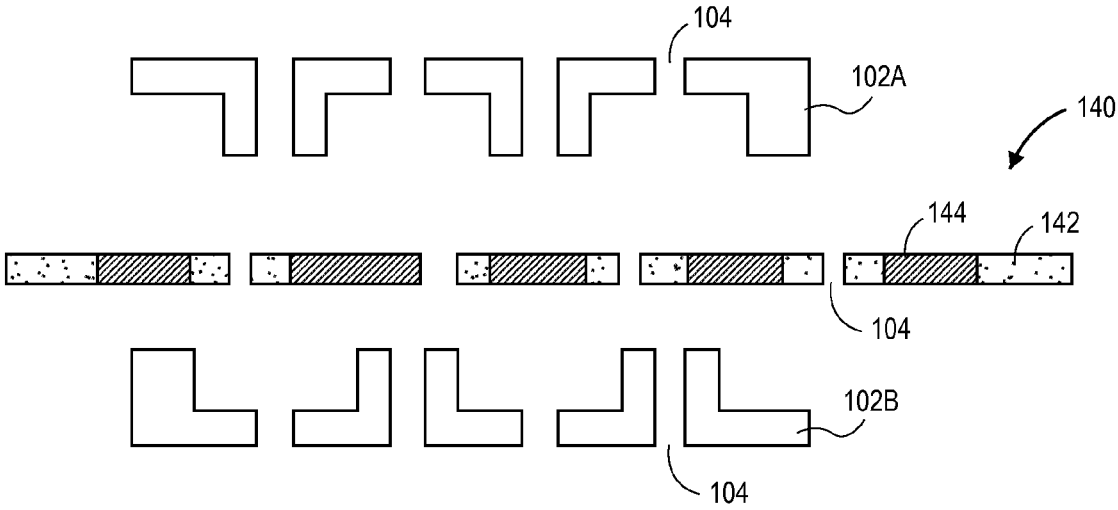
FIGS. 6A-6C are illustrations of a cross-sectional view of socket formed with a circuit film in accordance with embodiments of the invention.
Figure 6B:
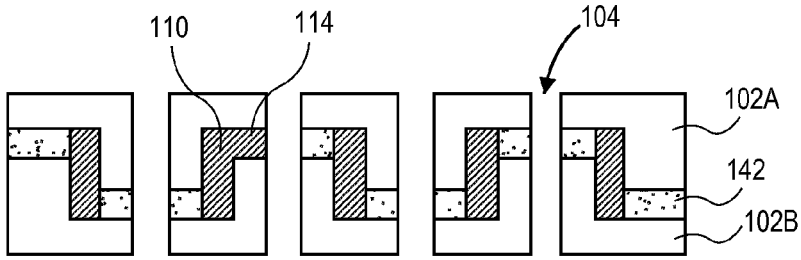
Figure 6C:
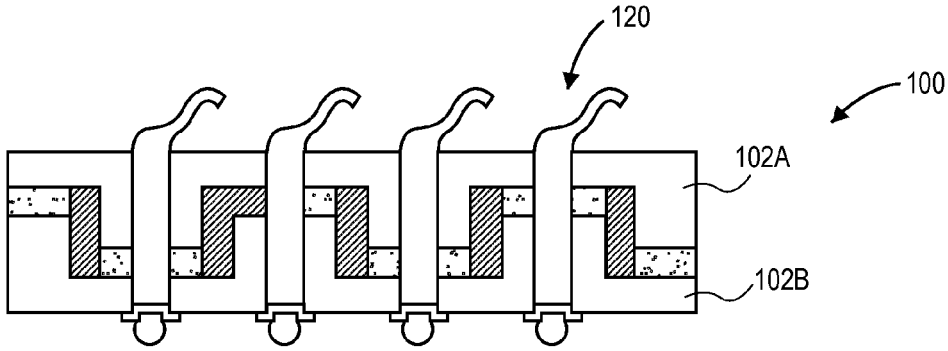

Referring to FIG. 6A-6C, a circuit film may be utilized with a first and second housing pieces to form the socket in accordance with embodiments of the invention. As illustrated in FIG. 6A, the first and second pieces 102A and 102B may include a series of protrusions and indentations. A flexible circuit film 140 may be placed over the second piece 102B, and the first piece 102A lowered so that the flexible circuit film 140 is contained within the housing 102. In an embodiment, the flexible circuit film 140 is joined to the first and second pieces 102A and 102B with an adhesive.

As illustrated in FIG. 6A, the flexible circuit film 140 may include insulative portions 142, conductive portions 144 and openings 104. When pressed together as illustrated in FIG. 6B, the conductive portions 144 form the conductive grid 114, including conductive trace 114, and the openings 104 align with openings 104 in the first and second pieces 102A and 102B to form contact openings 104. Conductive compliant contacts 120 may then be press-fit into the array of openings 104 as previously described.

Figure 7A:
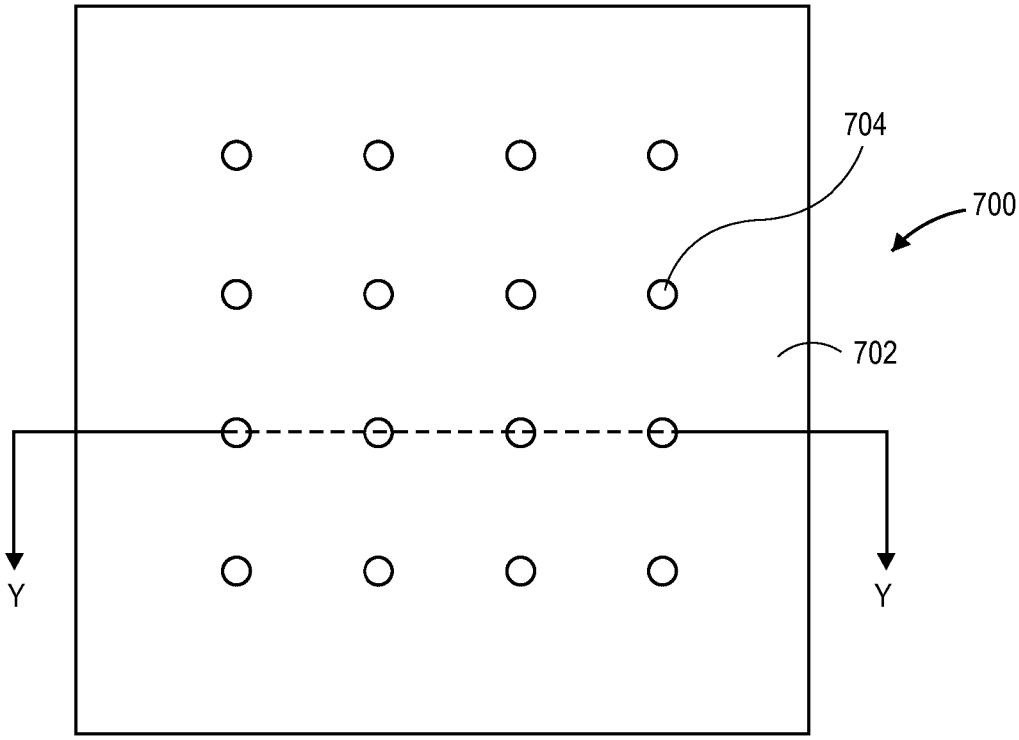
FIG. 7A is an illustration of a top view of a partially formed socket in accordance with embodiments of the invention.
Figure 7B:
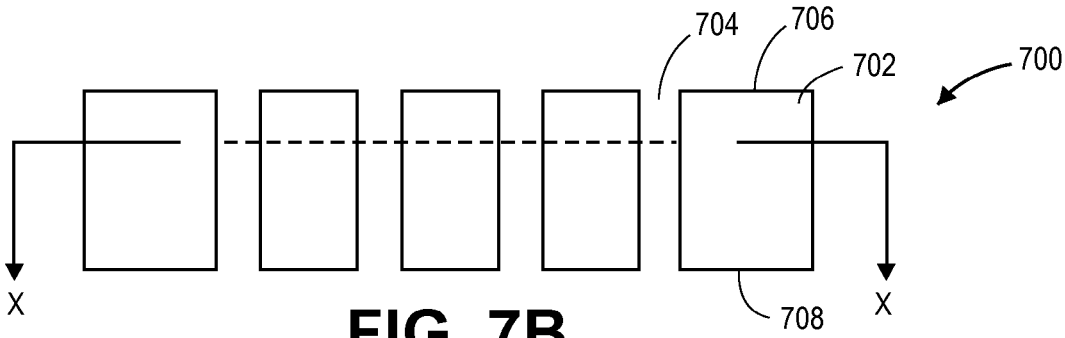
FIG. 7B is an illustration of a cross-sectional view of socket in accordance with embodiments of the invention.

FIG. 7A and FIG. 7B are illustrations of a partially formed socket in accordance with embodiments of the invention. FIG. 7A is an illustration of a top view taken along line y-y in FIG. 7B. FIG. 7B is an illustration of a side view taken along line x-x in FIG. 7A. Socket 700 includes a conductive polymer housing 702, an array of contact openings 704 within and surrounded by the conductive polymer housing. The array of contact openings 704 extend from a top surface 706 to a bottom surface 708 of the conductive polymer housing 702.

Figure 7C:
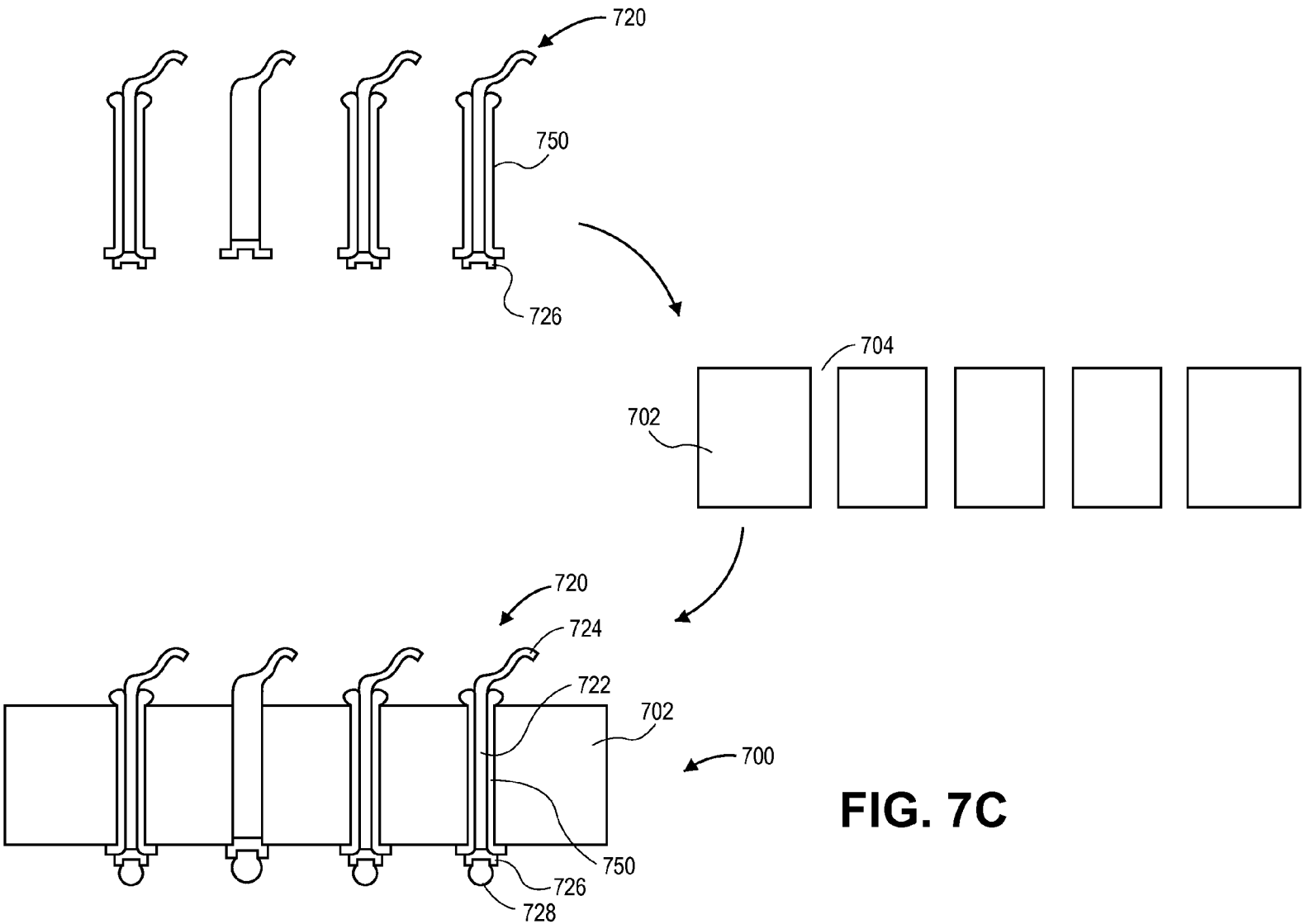
FIG. 7C is an illustration of press-fitting an insulative coated compliant contact into a socket housing in accordance with embodiments of the invention.
Figure 7D:
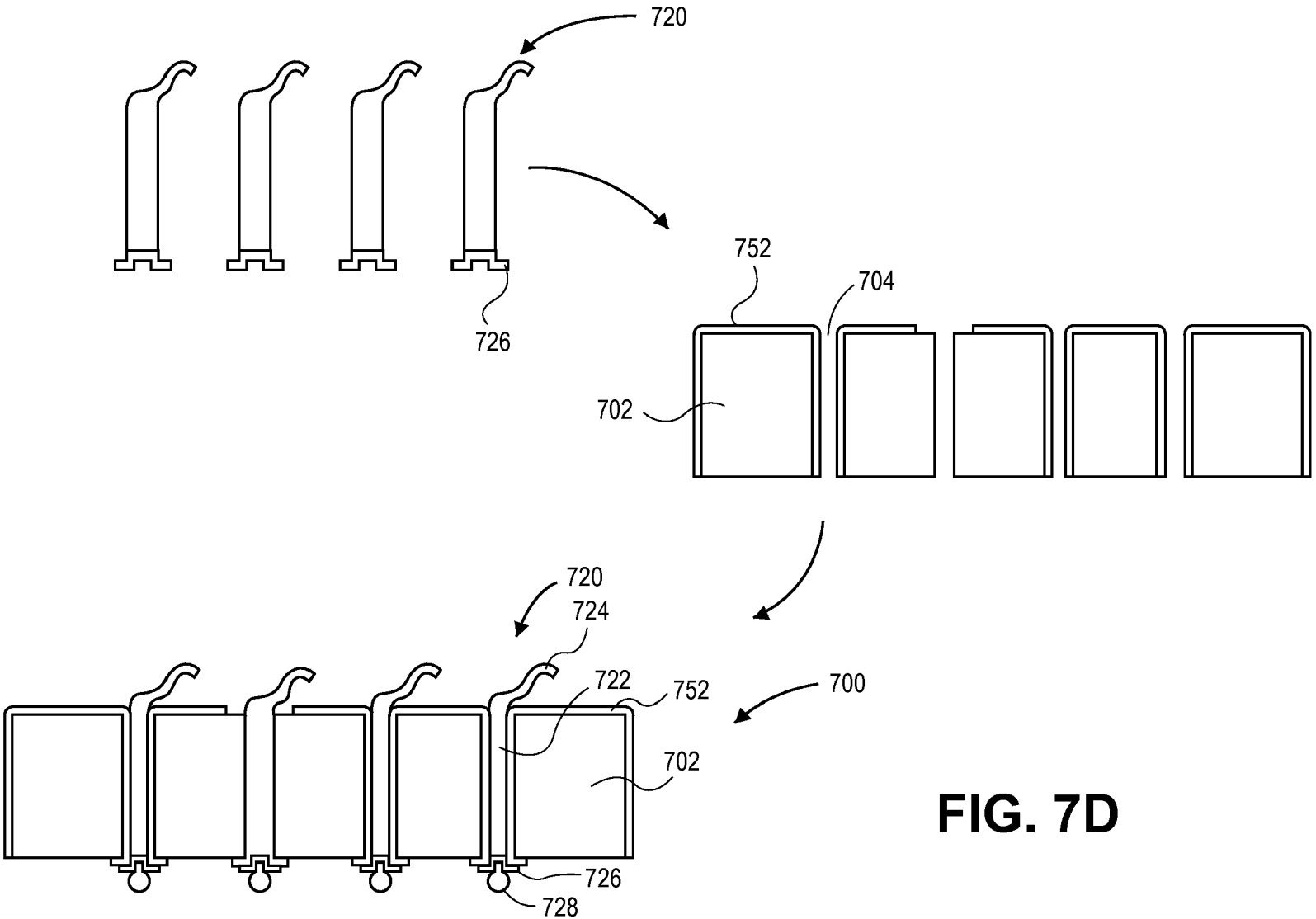
FIG. 7D is an illustration of press-fitting a compliant contact into an insulative layer coated socket housing in accordance with embodiments of the invention.

Referring to FIG. 7C and FIG. 7D, an array of conductive contacts 120 are disposed within the corresponding array of contact openings 704. As illustrated, the conductive contacts 720 may include a via portion 722 extending through the body of the conductive housing 702 and a compliant portion 724 above the top surface 706 of the conductive housing 702. For example, the compliant portion 724 may resemble a spring contact which exerts a force against an exposed land of an LGA package when fastened onto the socket 700. In an embodiment, the conductive compliant contacts 720 may include a bonding pad 726 and solder ball 728 for connecting to a substrate such as a printed circuit board (PCB). In another embodiment, the bonding pad and solder ball may be replaced with a pin (not illustrated) for connecting to a substrate.

In accordance with embodiments the array of conductive contacts 720 may be inserted into the corresponding array of contact openings 704 by press-fitting. For example, a pick and place machine can be utilized, or the conductive contacts 720 can be manually press-fit. In an embodiment, an array of conductive contacts 720 connected by a cross bar are press-fit into the corresponding array of contact openings, and the cross bar is subsequently removed. As previously described, bonding pads 726, solder balls 728 or pins may be connected to the conductive contacts 720. Depending on particular processing circumstances, any of the bonding pads 726, solder balls 728 or pins may be formed prior to or subsequent to press-fitting the conductive compliant contacts 720 into the contact openings 704.

Still referring to FIG. 7C-FIG. 7D, a plurality of the conductive contacts 720 are electrically isolated from the conductive polymer housing 702 which surrounds the array of contact openings 704. At least one of the conductive contacts is in electrical contact with the conductive polymer housing 702. Referring to FIG. 7C, the plurality of conductive contacts are electrically isolated from the conductive polymer housing 702 by an insulative coating 750 which surrounds the conductive contact. For example, the insulative coating may surround the via portion 722 of the conductive contact 720 in order to electrically isolate the conductive contact 720 from the conductive housing 702. In an embodiment, the insulative coating 750 also extends along a portion of the compliant portion 724 in order to insulate the compliant portion 724 from the top surface 706 of the conductive housing without interfering with the ability to be electrically joined to the exposed lands of an LGA package. As illustrated in FIG. 7C, the insulative coating 750 may be formed prior to press-fitting the conductive contact 720 into the contact opening 704. For example, the insulative coating 750 can be laminated or cast onto the plurality of conductive contacts 720.

Referring to FIG. 7D, the plurality of conductive contacts are electrically isolated from the conductive polymer housing 702 by an insulative layer 752 formed within the contact openings 704 prior to press-fitting the conductive contacts 720. In an embodiment, the insulative layer 752, or another insulative layer, extends along the top surface 706 of the conductive housing in order to insulate the compliant portion 724 from the top surface 706 of the conductive housing without interfering with the ability to be electrically joined to the exposed lands of an LGA package.

In an embodiment, at least one of the conductive contacts 720 is in electrical contact with the conductive housing 720. As illustrated in FIG. 7C, this may be accomplished by not forming an insulative coating 750 on the corresponding conductive contact 720. As illustrated in FIG. 7D, this may be accomplished by not forming insulative layer 752 within the corresponding contact opening 704.

Figure 8:
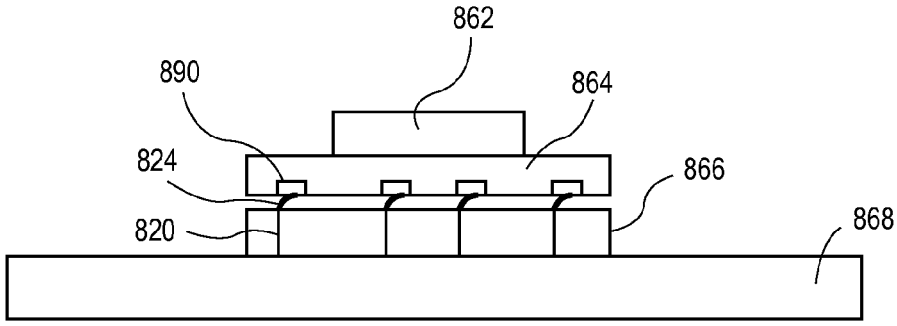
FIG. 8 is an illustration of in integrated circuit package, socket, and printed circuit board in accordance with an embodiment of the invention.

FIG. 8 is an illustration of an LGA package 864 housing an integrated circuit 862 such as a microprocessor, and a socket 866 connecting the LGA package 864 to a printed circuit board (PCB) 868. Integrated circuit 862 is not limited to a microprocessor and may be another device such as a memory device, digital signal processor, or another type of circuit. PCB 868 could be, for example, a motherboard of a computer system. As such, it may act as a vehicle to supply power, ground, and signals to the integrated circuit 862. The power, ground, and other signals are supplied to the integrated circuit 862 through the conductive contacts contained in the socket 866. The LGA socket 866 may include an array of compliant contacts 820 disposed within a housing, the compliant portions 824 of the compliant contacts aligned with the corresponding array of exposed lands 890 on a bottom surface of the LGA package 864.

Figure 9:
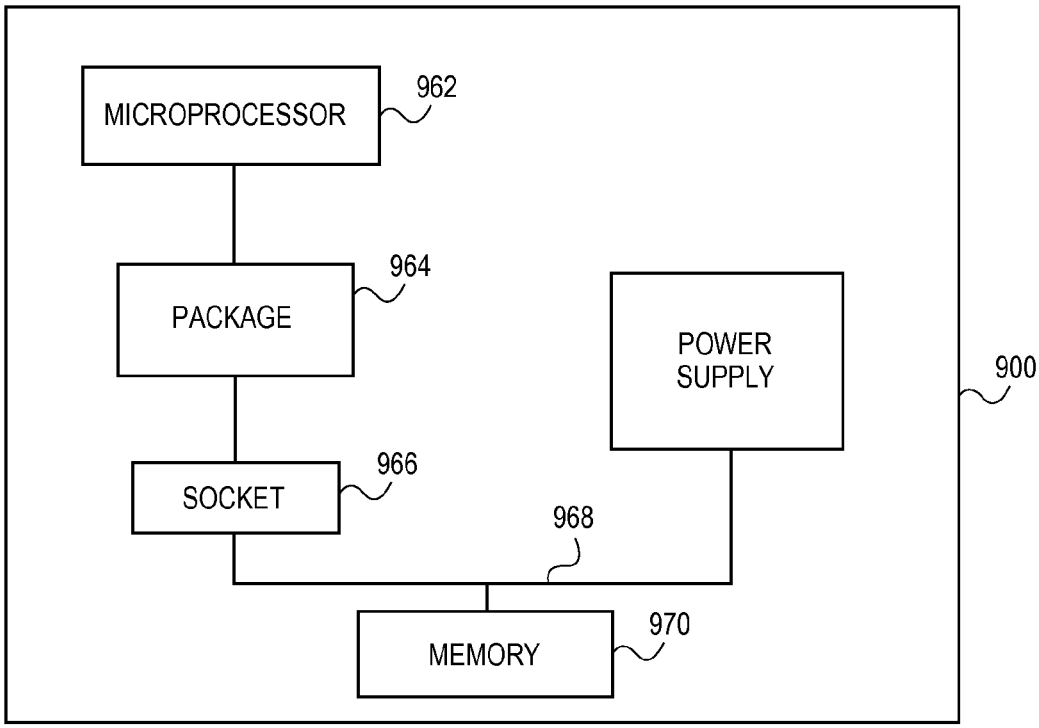
FIG. 9 is an illustration of a general-purpose electronic system in accordance with an embodiment of the invention.

FIG. 9 is an illustration of a general-purpose electronic system 900 in accordance with an embodiment of the invention. System 900 may be, for example, a computer, a wireless or wired communication device (e.g., telephone, modem, cell phone, pager, radio, etc.) a television, a monitor, or virtually any other type of electronic system. The electronic system 900 may be housed on one or more PCBs and include a microprocessor 962, integrated circuit package 964, socket 966, bus 968 and memory 970. The socket 966 may be any of the sockets described in accordance with the various embodiments of the invention.

Although the present invention has been described in language specific to structural features and/or methodological acts, it is to be understood that the invention defined in the appended claims is not necessarily limited to the specific features or acts described. The specific features and acts disclosed are instead to be understood as particularly graceful implementations of the claimed invention useful for illustrating the present invention.

What is claimed is:

1. A socket comprising:

a conductive polymer housing;

an array of contact openings within and surrounded by the conductive polymer housing, the array contact openings extending from a top surface to a bottom surface of the conductive polymer housing;

an array of conductive contacts corresponding to and disposed within the array of contact openings;

wherein a plurality of the conductive contacts are electrically isolated from the conductive polymer housing surrounding the array of contact openings, and one of the conductive contacts is in electrical contact with the conductive polymer housing.

2. The socket of claim 1, wherein the plurality of the conductive contacts are electrically isolated from the conductive polymer housing by an insulative material.

3. The socket of claim 2, wherein each conductive contact includes a coating of the insulative material surrounding the conductive contact.

4. The socket of claim 3, wherein the insulative material is a layer formed within the array of contact openings.

5. The socket of claim 2, wherein the conductive polymer housing comprises liquid crystal polymer.

6. The socket of claim 1, wherein the conductive contacts comprising the array of conductive contacts are compliant contacts, and the socket connects a land grid array (LGA) package to a circuit board.

7. The socket of claim 6, wherein the conductive compliant contact in electrical contact with the conductive polymer housing is electrically connected to a ground in the circuit board.

8. A socket comprising:

an insulative housing;

an array of contact openings within and surrounded by the insulative housing, the array contact openings extending from a top surface to a bottom surface of the insulative housing;

an array of conductive compliant contacts corresponding to and disposed within the array of contact openings; and a conductive grid embedded within the insulative housing, the conductive grid including an array of grid openings corresponding to the array of contact openings, wherein each individual grid opening surrounds a respective contact opening; and wherein a plurality of the conductive compliant contacts are electrically isolated from the conductive grid by the insulative housing, and at least one of the conductive compliant contacts is in electrical contact with the conductive grid.

9. The socket of claim 8, wherein the insulative housing comprises a first piece and second piece, and the array of contact openings extends from a top surface of the first piece to a bottom surface of the second piece.

10. The socket of claim 9, wherein the second piece includes indentations, and the conductive grid is disposed between the first and second pieces and within the indentations of the second piece.

11. The socket of claim 10, wherein the conductive grid is affixed to the second piece with an adhesive.

12. The socket of claim 10, further comprising a seed layer within the indentations of the second piece and below the conductive grid.

13. The socket of claim 9, wherein a circuit film is disposed between the first and second pieces, and the circuit film comprises the conductive grid.

14. The socket of claim 9, wherein the second piece comprises a platable resin portion and a non-platable resin portion.

15. The socket of claim 8, wherein the insulative polymer housing further comprises liquid crystal polymer.

16. A method of forming a socket comprising:

forming a socket housing comprising:

a top surface;

a bottom surface;

an array of contact openings extending from the top surface to the bottom surface; and a conductive grid embedded within the socket housing, the conductive grid including an array of grid openings corresponding to the array of contact openings, wherein each individual grid opening surrounds a corresponding contact opening; and press-fitting an array of compliant contacts into the array of contact openings.

17. The method of claim 16, further comprising applying an insulative coating to each of the compliant contacts prior to press-fitting.

18. The method of claim 16, further comprising applying an insulative layer within the array of contact openings prior to press-fitting.

19. The method of claim 16, wherein forming the socket housing comprises plating the conductive grid.

20. The method of claim 19, wherein forming the socket housing comprises laser activating a resin of the socket housing prior to plating.

* * * * *